US008092975B2

(12) United States Patent
Kurokawa

(10) Patent No.: US 8,092,975 B2
(45) Date of Patent: Jan. 10, 2012

(54) METHOD FOR PRODUCING TONER FOR DEVOLOPING ELECTROSTATIC IMAGE

(75) Inventor: Hisashi Kurokawa, Tokyo (JP)

(73) Assignee: Zeon Corporation, Tokyo (JP)

( * ) Notice: Subject to any disclaimer, the term of this patent is extended or adjusted under 35 U.S.C. 154(b) by 742 days.

(21) Appl. No.: 12/146,591

(22) Filed: Jun. 26, 2008

(65) Prior Publication Data

US 2009/0004594 A1 Jan. 1, 2009

(30) Foreign Application Priority Data

Jun. 29, 2007 (JP) ..... 2007-172050
Jun. 29, 2007 (JP) ..... 2007-173158

(51) Int. Cl.
*G03G 5/00* (2006.01)

(52) U.S. Cl. ..... 430/137.17; 430/137.15

(58) Field of Classification Search ..... 430/137.1, 430/137.15, 137.16, 137.17; 521/32; 524/32; 526/62

See application file for complete search history.

(56) References Cited

U.S. PATENT DOCUMENTS

| | | | | |
|---|---|---|---|---|
| 4,320,215 | A * | 3/1982 | Yonezawa et al. | 526/62 |
| 4,804,610 | A * | 2/1989 | Mori et al. | 430/137.17 |
| 2002/0187416 | A1* | 12/2002 | Jiang et al. | 430/137.14 |
| 2003/0114544 | A1* | 6/2003 | Klipper et al. | 521/32 |
| 2004/0214935 | A1* | 10/2004 | Cholli et al. | 524/342 |
| 2006/0269866 | A1* | 11/2006 | Hagino | 430/137.15 |
| 2007/0207402 | A1* | 9/2007 | Takagi et al. | 430/110.2 |
| 2008/0085461 | A1* | 4/2008 | Kurokawa et al. | 430/137.17 |

FOREIGN PATENT DOCUMENTS

| | | | |
|---|---|---|---|
| JP | 2001-005223 | A | 1/2001 |
| JP | 2001-005226 | A | 1/2001 |
| JP | 2007-052039 | A | 3/2007 |
| JP | 2007-072327 | A | 3/2007 |
| WO | 2006/013847 | A1 | 2/2006 |

OTHER PUBLICATIONS

Japanese Office Action dated Aug. 30, 2011, issued in corresponding Japanese Patent Application No. 2007-172050.

* cited by examiner

*Primary Examiner* — Mark F Huff
*Assistant Examiner* — Stewart Fraser
(74) *Attorney, Agent, or Firm* — Westerman, Hattori, Daniels & Adrian, LLP

(57) ABSTRACT

Provided is a method for producing a toner for developing electrostatic image which inhibits the generation of small diameter microparticles as a by-product in the polymerization for the toner, which includes easy or simple washing treatment (washing/filtration/dehydration), and which is excellent in productivity.

The method is a method for producing a toner for developing electrostatic image comprising a suspending step of suspending a polymerizable monomer composition containing at least a polymerizable monomer and a colorant into an aqueous dispersion medium containing a dispersion stabilizer to yield a suspension wherein droplets of the polymerizable monomer composition are dispersed, and a step of subjecting the suspension to suspension polymerization in the presence of a polymerization initiator to yield colored resin particles, wherein the colorant is a metal-containing organic pigment, and when the suspension polymerization is performed, the suspension contains 0.01 to 1 part by weight of an inhibitor of small diameter microparticle production for 100 parts by weight of the polymerizable monomer.

16 Claims, No Drawings

METHOD FOR PRODUCING TONER FOR DEVOLOPING ELECTROSTATIC IMAGE

BACKGROUND OF THE INVENTION

1. Field of the Invention

The present invention relates to a method for producing a toner for developing electrostatic image (hereinafter referred to merely as a toner as the case may be) used to develop an electrostatic latent image in electrophotography, electrostatic recording, electrostatic printing and others, more specifically, a method for producing a toner for developing electrostatic image which is excellent in productivity.

2. Description of the Related Art

In recent years, needs of colorizing images have been increasing for image forming devices using electrophotography, such as a copying machine, a facsimile, and a printer. In color electrophotography, reproducibility of vivid color tones is required, and toner for color which can cope also with printing of highly minute images such as a photograph is required.

Into image forming devices which can cope with color electrophotography are set up toners in three colors of cyan (blue), magenta (red) and yellow (yellow), which are the three primary colors, and a toner in black (black). The four-color toners are overlapped onto each other on a printing paper surface as the need arises to perform color mixing (intermediate colors, or secondary colors), thereby reproducing color tones.

In order to make the resolution of images high, it is suitable to adopt a spherical toner having a small particle diameter. As a method for producing the toner, a polymerization method is suggested.

Examples of the toner producing method based on the polymerization method include suspension polymerization, emulsion aggregation, and dispersion polymerization. For example, in the suspension polymerization, a polymerizable monomer, a colorant and one or more optional different additives are first added so as to prepare a polymerizable monomer composition, and then the polymerizable monomer composition is charged into an aqueous dispersion medium containing a dispersion stabilizer to disperse the composition. Furthermore, a high-speed mixer or the like is used to apply a high shear thereto, thereby forming droplets of the polymerizable monomer composition. Thereafter, the aqueous dispersion medium in which the polymerizable monomer composition, which is in a droplet form, is dispersed undergoes polymerization in the presence of a polymerization initiator. The resultant is then subject to washing treatment (washing, filtration and dehydration) followed by drying so as to yield colored resin particles.

In the case of yielding colored resin particles by a polymerization method, the following great advantages are produced as compared with any conventional pulverization method: at a stage when particles are formed (a droplet-forming stage and a polymerization stage in the polymerization method), spherical colored resin particles having a small particle diameter can be produced and further the particle diameter distribution can be adjusted into a sharper form. In recent years, however, as the level of desires for image printing giving a high resolution and a high image quality has been become higher, attempts for making the particle diameter of toner smaller have been made. About polymerization toner also, a new problem has been pointed out.

As the problem, pointed out is a matter that in a polymerization step in a toner producing method, unnecessary particles having a microparticle diameter are generated as a by-product besides target colored resin particles, whereby bad effects are produced onto the productivity of toner, and printing performances. The micro by-product particles are the so-called submicron-order particles, and are particles containing no colorant (hereinafter referred to as "small diameter microparticles").

When small diameter microparticles are generated as a by-product in polymerization for producing a toner, a filtering member is choked up with a part of the small diameter microparticles in the washing treatment (washing, filtration and dehydration) of yielded colored resin particles when the particles are separated from the aqueous dispersion medium. For this reason, the efficiency of the washing treatment lowers to result in a drop in the productivity of the toner.

When a toner containing small diameter microparticles is used for printing, the small diameter microparticles adhere easily to members in a developing device since the microparticles have a large adhesive force. The adhering small diameter microparticles accumulate gradually so that filming (adherence) is generated in the members. When filming is generated on a photosensitive member inside the developing device, the surface of the photosensitive member is unsatisfactorily electrified so that a desired electrostatic latent image cannot be formed on the photosensitive member. This causes a fall in printing performance.

A polymerization method makes it possible to produce easily small-particle-diameter colored resin particles having a volume average particle diameter Dv of about 3 to 15 μm. However, as the particle diameter range to be aimed is shifted toward a smaller particle diameter, the range becomes closer to the particle diameters of small diameter microparticles in submicron order as described above. Thus, it becomes difficult to separate the desired colored resin particles from the unnecessary small diameter microparticles. It is therefore desired to develop a toner producing method which is excellent in toner productivity and gives a toner excellent in printing performance by inhibiting small diameter microparticles from being generated as a by-product. In order to respond to the above requirements, various attempts are suggested.

For example, PCT International Publication No. WO2006/013847 discloses a polymerization toner producing method of charging a polymerizable monomer composition containing a polymerizable monomer, a colorant and a charge control agent into an aqueous dispersion medium, stirring the composition, adding thereto t-butylperoxy-2-ethyl hexanoate (trade name: PERBUTYL O, manufactured by NOF Corporation) as a polymerization initiator, making the composition into particles, and adding thereto a hydroquinone compound as a water-soluble polymerization inhibitor (an inhibitor of small diameter microparticle production) before the monomer is polymerized.

Japanese Patent Application Laid-Open No. 2007-52039 discloses a method of producing a polymerization toner made of colored resin particles obtained by polymerizing a polymerizable monomer composition containing a polymerizable monomer and a colorant in an aqueous dispersion medium, using as a polymerization initiator t-butylperoxy-2-ethyl butanoate (trade name: TRIGONOX 27, manufactured by Akzo Nobel N. V.; molecular weight: 188, purity: 98%), which is an organic peroxide having a molecular weight of 205 or less and a purity of 90% or more.

However, the investigation of the inventor has demonstrated that the hydroquinone compound used as a small diameter microparticle inhibitor in PCT International Publication No. WO2006/013847 does not necessarily produce an effect of inhibiting the generation of small diameter microparticles as a by-product. In Japanese Patent Application Laid-Open No. 2007-52039, t-butylperoxy-2-ethyl butanoate, which is used as a polymerization initiator, produces a high effect of decreasing the remaining amount of a decomposition product (volatile organic compound) of the polymerization initiator remaining in the toner, and other products, which cause a bad smell. However, it has been proved that the effect of inhibiting the generation of small diameter microparticles as a by-product is not very high.

Furthermore, when the inventor has investigated a method for inhibiting the generation of small diameter microparticles as a by-product, the inventor has obtained a finding that: in a case where a colorant containing a metal (metal-containing organic pigment) is used to produce a toner, a metal not taken in the pigment species which constitutes the metal-containing organic pigment, which will be referred to as a "free metal" herein after, may become an inducing material which produces small diameter microparticles as a by-product; and further the metal may become a material which blocks the effect of the small diameter microparticles.

SUMMARY OF THE INVENTION

An object of the present invention is to provide a method for producing a toner for developing electrostatic image which inhibits the generation of small diameter microparticles as a by-product in the polymerization for the toner, which includes easy or simple washing treatment (washing/filtration/dehydration), and which is excellent in productivity.

The inventor has made eager investigations for attaining the object to find out that when a suspension polymerization is conducted, the addition of a suspension therefor is performed in such a manner that the suspension contains an inhibitor of small diameter microparticle production in an amount in a specified range, whereby the generation of small diameter microparticles, which are to be generated as a by-product in polymerization for producing a toner, can be effectively inhibited. On the basis of this finding, the present invention has been made.

Accordingly, the method of the invention for producing a method for producing a toner for developing electrostatic image is a method for producing a toner for developing electrostatic image, comprising a suspending step of suspending a polymerizable monomer composition containing at least a polymerizable monomer and a colorant into an aqueous dispersion medium containing a dispersion stabilizer to yield a suspension wherein droplets of the polymerizable monomer composition are dispersed, and a step of subjecting the suspension to suspension polymerization in the presence of a polymerization initiator to yield colored resin particles, wherein the colorant is a metal-containing organic pigment, and when the suspension polymerization is performed, the suspension contains 0.01 to 1 part by weight of an inhibitor of small diameter microparticle production for 100 parts by weight of the polymerizable monomer.

About the method for producing a toner for developing electrostatic image of the invention, particularly preferred embodiments thereof are as follows.

A first embodiment thereof is a method for producing a toner for developing electrostatic image comprising a suspending step of suspending a polymerizable monomer composition containing at least a polymerizable monomer and a colorant into an aqueous dispersion medium containing a dispersion stabilizer to yield a suspension wherein droplets of the polymerizable monomer composition are dispersed, and a step of subjecting the suspension to suspension polymerization in the presence of a polymerization initiator to yield colored resin particles, wherein the colorant is a metal-containing organic pigment, and when the suspension polymerization is performed, the suspension contains 0.01 to 1 part by weight of a metal chelate forming agent, and 0.01 to 1 part by weight of an inhibitor of small diameter microparticle production for 100 parts by weight of the polymerizable monomer.

A second embodiment thereof is a method for producing a toner for developing electrostatic image comprising a suspending step of suspending a polymerizable monomer composition containing at least a polymerizable monomer and a colorant into an aqueous dispersion medium containing a dispersion stabilizer to yield a suspension wherein droplets of the polymerizable monomer composition are dispersed, and a step of subjecting the suspension to suspension polymerization in the presence of a polymerization initiator to yield colored resin particles, wherein the colorant is a copper phthalocyanine pigment wherein the content of free copper is 500 ppm or less, and when the suspension polymerization is performed, the suspension contains 0.01 to 1 part by weight of an inhibitor of small diameter microparticle production for 100 parts by weight of the polymerizable monomer.

According to the method for producing a toner for developing electrostatic image of the invention as described above, provided is a method for producing a toner for developing electrostatic image which can effectively inhibit the generation of small diameter microparticles as a by-product in the polymerization for the toner, includes easy or simple washing treatment (washing/filtration/dehydration), and is excellent in productivity.

DETAILED DESCRIPTION OF THE INVENTION

A method for producing a toner for developing electrostatic image of the invention is a method comprising a suspending step of suspending a polymerizable monomer composition containing at least a polymerizable monomer and a colorant into an aqueous dispersion medium containing a dispersion stabilizer to yield a suspension wherein droplets of the polymerizable monomer composition are dispersed, and a step of subjecting the suspension to suspension polymerization in the presence of a polymerization initiator to yield colored resin particles, wherein the colorant is a metal-containing organic pigment, and when the suspension polymerization is performed, the suspension contains 0.01 to 1 part by weight of an inhibitor of small diameter microparticle production for 100 parts by weight of the polymerizable monomer.

The method of the invention for producing a toner for developing electrostatic image will be described hereinafter.

(1) Step of Preparing a Polymerizable Monomer Composition

A polymerizable monomer, a colorant and, if required, one or more optional different additives such as a charge control agent are first mixed with each other to dissolve the soluble components, thereby preparing a polymerizable monomer composition. When the polymerizable monomer composition is prepared, the mixing is performed using, for example, a media type dispersing machine.

In the invention, the polymerizable monomer is a monomer having a polymerizable functional group. A main component of the polymerizable monomer is preferably a monovinyl monomer. Examples of the monovinyl monomer include styrene; styrene derivatives such as vinyltoluene, and α-methylstyrene; acrylic acid, and methacrylic acid; acrylic acid esters such as methyl acrylate, ethyl acrylate, propyl acrylate, butyl acrylate, 2-ethylhexyl acrylate, and dimethylaminoethyl acrylate; methacrylic acid esters such as methyl methacrylate, ethyl methacrylate, propyl methacrylate, butyl methacrylate, 2-ethylhexyl methacrylate, and dimethylaminoethyl methacrylate; amide compounds such as acrylamide, and methacrylamide; and olefins such as ethylene, propylene, and butylene. The monovinyl monomers may be used alone or in combination of two or more thereof.

Of the monovinyl monomers, styrene, styrene derivatives, acrylic acid esters and methacrylic acid esters are preferably used.

In order to improve the shelf stability (blocking resistance) of the toner, it is preferred to use any crosslinkable polymerizable monomer, as a partial species of the polymerizable monomer, together with the above-mentioned monovinyl monomer. The crosslinkable polymerizable monomer is a monomer having two or more polymerizable functional groups. Examples of the crosslinkable polymerizable monomer include aromatic divinyl compounds such as divinylbenzene, divinylnaphthalene, and derivatives thereof; ethylenically unsaturated carboxylic acid esters such as ethylene glycol dimethacrylate, and diethylene glycol dimethacrylate; divinyl compounds such as N,N-divinylaniline, and divinyl ether; compounds having three or more vinyl groups such as trimethylolpropane trimethacrylate, and dimethylolpropane tetraacrylate. The crosslinkable polymerizable monomers may be used alone or in combination of two or more thereof.

In the invention, the crosslinkable polymerizable monomer may be added at the stage when droplets of the polymerizable monomer composition will be formed in an aqueous dispersion medium in a suspending step.

In the invention, it is desired to use the crosslinkable polymerizable monomer usually in a proportion of 0.1 to 5 parts by weight, preferably in that of 0.3 to 2 parts by weight for 100 parts by weight of the monovinyl monomer.

It is also preferred to use, as a partial species of the polymerizable monomer, any macro monomer together with the above-mentioned monovinyl monomer in order to improve the balance between the shelf stability of the toner and the low-temperature fixability thereof. The macro monomer is a reactive oligomer or polymer which has, in a terminal of its molecular chain, a polymerizable carbon-carbon unsaturated bond and usually has a number-average molecular weight (Mn) of 1,000 to 30,000. The macromonomer is preferably an oligomer or polymer having a higher glass transition temperature (Tg) than the Tg of the polymer (binder resin) obtained by polymerizing the polymerizable monomer.

In the invention, it is desired to use the macro monomer usually in a proportion of 0.01 to 10 parts by weight, preferably in that of 0.03 to 5 parts by weight, more preferably in that of 0.1 to 2 parts by weight for 100 parts by weight of the monovinyl monomer.

In the invention, a metal-containing organic pigment is used as the colorant.

In general, the metal-containing organic pigment contains, as an impurity, a metal not taken in the pigment species which constitutes the metal-containing organic pigment. This metal impurity elutes out into a solvent to turn to a metal ion; in the invention, this metal ion is referred to as a free metal.

The metal-containing organic pigment used in the invention is preferably, for example, a pigment comprising a phthalocyanine derivative, such as a copper phthalocyanine pigment, a halogenated copper phthalocyanine pigment, a sulfonated copper phthalocyanine pigment, an aluminum phthalocyanine pigment, or a zinc phthalocyanine pigment.

Of these pigments, a copper phthalocyanine pigment is preferred from the viewpoint of light resistance, color developability and safety.

In the invention, it is preferred that the copper phthalocyanine pigment is a copper phthalocyanine pigment wherein the content of free copper is decreased into a specified amount or less.

In the invention, "free copper" is copper which is not taken in as a central metal of a copper phthalocyanine compound in the step of producing a copper phthalocyanine pigment, so as to be present as an impurity in the copper phthalocyanine pigment, and is copper which is released from the copper phthalocyanine pigment at the time of dispersing the copper phthalocyanine pigment into a solvent, so as to elute out as a copper ion into the solvent.

In the invention, the "copper phthalocyanine pigment" is a complex formed by substituting two hydrogen atoms at the center of a phthalocyanine compound having a cyclic structure with a copper ion.

In the invention, the "copper phthalocyanine pigment" is a generic name of unsubstituted copper phthalocyanine pigments, which do not have any substituent, such as a halogen atom, and substituted copper phthalocyanine pigments, which have a substituent such as a halogen atom.

Examples of the copper phthalocyanine pigment used preferably in the invention include unsubstituted copper phthalocyanine pigments, such as C.I. Pigment Blues 15, 15:1, 15:2, 15:3, 15:4, and 15:6; and substituted copper phthalocyanine pigments, such as C.I. Pigment Greens 7, and 36.

Of these pigments, preferred are unsubstituted copper phthalocyanine pigments, and particularly preferred are C.I. Pigment Blues 15:3, and 15:4 since vivid color tones are satisfactorily reproduced.

The copper phthalocyanine pigment used in the invention is a copper phthalocyanine pigment wherein the content of free copper is reduced preferably into 500 ppm or less, more preferably into 300 ppm or less, even more preferably into 200 ppm or less.

If the content of free copper is more than the range, the generation of small diameter microparticles as a by-product in polymerization cannot be sufficiently inhibited. Thus, when the polymerization product is subjected to washing treatment (washing/filtration/dehydration), inconveniences such as clogging are generated, so that the productivity of the toner lowers. Additionally, a bad effect may be produced onto printing performances of the resultant toner.

In the invention, the method for controlling the content of free copper contained in the copper phthalocyanine pigment is not particularly limited as long as the method makes it possible to decrease the content of free copper into a specified amount or less (preferably, 500 ppm or less). The method may be a known method.

In an example of the method for controlling the content of free copper, phthalic anhydride, urea and copper (I) chloride are first added to a high boiling point solvent, and the resultant is heated in the presence of a catalyst while stirred. In this way, a prepared solution is yielded. The resultant prepared solution is caused to undergo operations of methanol washing, treatment with a diluted acid/a diluted alkali, and water washing, so as to yield a crude copper phthalocyanine pigment (a crude).

The yielded crude copper phthalocyanine pigment is gradually added to concentrated sulfuric acid, so as to be dissolved therein. The resultant concentrated sulfuric acid solution is gradually added to ice water to precipitate a copper phthalocyanine pigment crystal. The crystal is washed with water to yield a purified copper phthalocyanine pigment. Salt and diethylene glycol are added to the yielded purified copper phthalocyanine pigment, and a kneading machine such as a kneader is used to abrade and pulverize the mixture while the mixture is heated. In this way, a product is obtained. The resultant product is caused to undergo operations of diluted acid treatment, and water washing, thereby yielding a copper phthalocyanine pigment wherein the content of free copper is reduced into a specified amount or less (500 ppm or less).

The above-mentioned metal-containing organic pigments may be used alone or in combination of two or more thereof.

In the invention, it is desired to use the metal-containing organic pigment preferably in a proportion of 1 to 10 parts by weight, preferably in that of 2 to 8 parts by weight for 100 parts by weight of the monovinyl monomer.

Also in the invention, it is desired to use the copper phthalocyanine pigment preferably in a proportion of 2 to 10 parts by weight, preferably in that of 3 to 8 parts by weight for 100 parts by weight of the monovinyl monomer.

One of the different additives which are used to improve the peel ability of the toner from a fixing roller is preferably a release agent.

The release agent is not particularly limited as long as the agent is an agent used ordinarily as a release agent for toner. Examples thereof include polyolefin waxes such as low-molecular-weight polyethylene, low-molecular-weight polypropylene, and low-molecular-weight polybutylene; natural waxes such as candelilla, carnauba, rice wax, haze wax, and jojoba; petroleum waxes such as paraffin, microcrystalline, and petrolatum; mineral waxes such as montan, ceresin, and ozokerite; synthetic waxes such as Fischer-Tropsch wax; and polyhydric alcohol ester compounds including pentaerythritol esters such as pentaerythritol tetramyristate, pentaerythritol tetrapalmitate, pentaerythritol tetrastearate, and pentaerythritol tetralaurate, and dipentaerythritol esters such as dipentaerythritol hexamyristate, dipentaerythritol hexapalmitate, and dipentaerythritol hexylaurate. These release agents may be used alone or in combination of two or more thereof.

In the invention, it is desired to use the release agent usually in a proportion of 0.1 to 30 parts by weight, preferably in that of 1 to 20 parts by weight for 100 parts by weight of the monovinyl monomer.

In order to improve the charging property of the toner, various species of a charge control agent having positively charging ability or negatively charging ability may be used as the different additive(s).

The charge control agent is not particularly limited as long as the agent is a charge control agent used ordinarily as a charge control agent for toner. In the invention, it is preferred to use a charge control agent having positively charging ability to yield a positively-chargeable toner. Furthermore, out of species of the charge control agent having positively charging ability, a positively-chargeable charge control resin is preferably used since the resin is high in compatibility with the polymerizable monomer so that a stable charging property (charging stability) can be given to the toner particles.

As the charge control resin having positively charging ability, for example, various commercially available products may be used. Examples thereof include FCA-161P (trade name of a styrene/acrylic resin), FCA-207P (trade name of a styrene/acrylic resin) and FCA-201-PS (trade name of a styrene/acrylic resin) manufactured by Fujikura Kasei Co., Ltd.

In the invention, it is desired to use the charge control agent usually in a proportion of 0.01 to 10 parts by weight, preferably in that of 0.03 to 8 parts by weight for 100 parts by weight of the monovinyl monomer.

It is preferred to use, as one of the different additives, a molecular weight modifier.

The molecular weight modifier is not particularly limited as long as the modifier is a substance used ordinarily as a molecular weight modifier for toner. Examples thereof include mercaptans such as t-dodecylmercaptan, n-dodecylmercaptan, n-octylmercaptan, and 2,2,4,6,6-pentamethylheptane-4-thiol; and thiuramdisulfides such as tetramethylthiuramdisulfide, tetraethylthiuramdisulfide, tetrabutylthiuramdisulfide, N,N'-dimethyl-N,N'-diphenylthiuramdisulfide, and N,N'-dioctadecyl-N,N'-diisopropylthiuramdisulfide. These molecular weight modifiers may be used alone or in combination of two or more thereof.

In the invention, the molecular weight modifier may be added at the stage when droplets of the polymerizable monomer composition will be formed in an aqueous dispersion medium in a suspending step.

In the invention, it is desired to use the molecular weight modifier usually in a proportion of 0.01 to 10 parts by weight, preferably in that of 0.1 to 5 parts by weight for 100 parts by weight of the monovinyl monomer.

In the invention, it is preferred to use a metal chelate forming agent in order to inhibit effectively the generation of small diameter microparticles as a by-product in the polymerization for the toner.

The timing when the metal chelate forming agent is added in the invention is not particularly limited as long as the suspension can contain the metal chelate forming agent in an amount in a specified range when the suspension is subjected to suspension polymerization. In particular, it is more preferred to add the metal chelate forming agent to the polymerizable monomer composition when the composition is prepared than to the aqueous dispersion medium since the effect of inhibiting the generation of small diameter microparticles as a by-product in the polymerization is higher.

When the metal chelate forming agent is added to the aqueous dispersion medium, the metal chelate forming agent may be added to the aqueous dispersion medium at a stage before or after a dispersion stabilizer is added, before or after the polymerizable monomer composition is charged, before or after a polymerization initiator is added, or before or after an inhibitor of small diameter microparticle production is added.

In the invention, the "metal chelate forming agent" is a compound (ligand) having a coordinating moiety (coordinating atom) capable of coordinating a metal not taken in the pigment species which constitutes the metal-containing organic pigment, which will be referred to as a "free metal (metal ion) originating from the metal-containing organic pigment" hereinafter, so as to form a chelate compound (coordinate compound).

In general, any ligand is classified into a monodentate ligand, which has only one coordinating moiety, and a polydentate ligand, which has two or more coordinating moieties.

Furthermore, the polydentate ligand is classified into a bidentate ligand, which has two coordinating moieties, a tridentate ligand, which has three coordinating moieties, a tetradentate ligand, which has four coordinating moieties, a pentadentate ligand, which has five coordinating moieties, a hexadentate ligand, which has six coordinating moieties, and others.

Examples of the metal chelate forming agent of a bidentate ligand include bidentate ligands having two acidic groups, such as malonic acid (HOOC—$CH_2$—COOH), oxalic acid (HOOC—COOH), phthalic acid ($C_6H_4(COOH)_2$), glycolic acid (HO—$CH_2$—COOH), and salicylic acid (HO—$C_6H_4$—COOH); bidentate ligands having a single acidic group and a single non-acidic group, such as 8-quinolinol (Formula 4 illustrated below), acetylacetone ($CH_3$— (CO)—$CH_2$—(CO)—$CH_3$), dimethylglyoxime (Formula 5 illustrated below), dithizone (Formula 6 illustrated below), and salicylaldehyde (Formula 7 illustrated below); and bidentate ligands having two non-acidic groups, such as ethylenediamine ($NH_2$—$(CH_2)_2$—$NH_2$), 2,2'-bipyridine (Formula 8 illustrated below), and 1,10-phenanthroline (Formula 9 illustrated below).

The metal chelate forming agent used in the invention is preferably, out of the above-mentioned bidentate ligands, a bidentate ligand having a single acidic group and a single non-acidic group. For example, in 8-quinolinol (Formula 4 illustrated below), the phenolichydroxyl group at the 8-position behaves as an acidic group while the nitrogen atom at the 1-position behaves as a non-acidic group. In dimethylglyoxime (Formula 5 illustrated below), one of the oxime groups (═NOH) behaves as an acid group while the other oxime group (═NOH) behaves as a non-acidic group. In dithizone (Formula 6 illustrated below), the imino group (—NH—) behaves as an acidic group while one nitrogen atom in the azo group (—N═N—) behaves as anon-acidic group. In salicylaldehyde (Formula 7 illustrated below), the phenolic hydroxyl group at the 2-position behaves as an acid group while the aldehyde group at the 1-position behaves as a non-acidic group.

Formula 4:

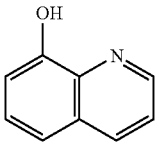

Formula 5:

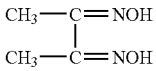

Formula 6:

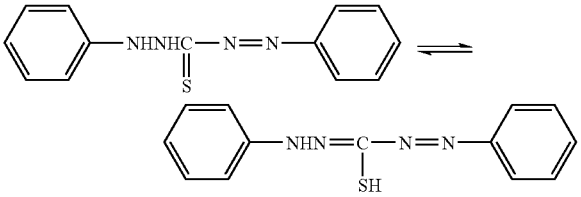

Formula 7:

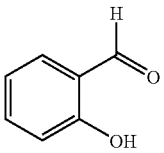

Formula 8:

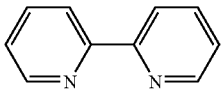

-continued

Formula 9:

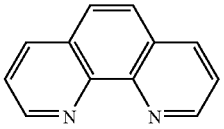

Examples of the metal chelate forming agent of a hexadentate ligand include aminopolycarboxylic acids, such as ethylenediaminetetraacetic acid ($(HOOCCH_2)_2$—N—$CH_2CH_2$—N—$(CH_2COOH)_2$) propylenediaminetetraacetic acid ($(HOOCCH_2)_2$—N—$CH_2CH_2CH_2$—N—$(CH_2COOH)_2$) butylenediaminetetraacetic acid ($(HOOCCH_2)_2$—N—$CH_2CH_2CH_2CH_2$—N—$(CH_2COOH)_2$), and pentylenediaminetetraacetic acid ($(HOOCCH_2)_2$—N—$CH_2CH_2CH_2CH_2CH_2$—N—$(CH_2COOH)_2$), and sodium salts or ammonium salts thereof.

The metal chelate forming agent used in the invention is not particularly limited as long as the agent is a compound (ligand) capable of capturing a free metal (metal ion). The agent is preferably an agent which functions as a bidentate ligand when the agent is in an alkaline environment. The metal chelate forming agent used in the invention is preferably a ligand wherein the total number of negative electric charges is equal to the number of positive electric charges of a free metal, that is, a ligand having one or more negative electric charges which can cancel positive electric charges of a free metal.

When the number of positive electric charges of the free metal originating from the metal-containing organic pigment is, for example, +2, a metal chelate forming agent of a bidentate ligand is preferably used. It is preferred to use, out of bidentate ligands, a bidentate ligand having a single acidic group and a single non-acidic group. As this bidentate ligand, 8-quinolinol (Formula 4 illustrated above) is in particular preferably used since the compound has a high effect of capturing (chelating) a free metal.

The metal chelate forming agent used in the invention is preferably soluble in an alkaline aqueous dispersion medium before the agent forms a chelate (before the agent coordinates to a free metal), and is more preferably soluble in an aqueous dispersion medium having a pH of 7.5 to 11 out of alkaline aqueous dispersion medium. The agent is preferably a metal chelate forming agent having a nature that the agent becomes insoluble when the agent coordinates to a free metal to form a chelate compound (coordinate compound).

The metal chelate forming agent having the above-mentioned natures is soluble in an alkaline aqueous dispersion medium before a chelate is formed (before the agent coordinates to a free metal); thus, the agent is easily present in an alkaline aqueous dispersion medium (in an aqueous phase). When the agent coordinates to the free metal to form a chelate compound (coordinate compound), the agent is made insoluble; accordingly, the agent tends to be taken in the polymerizable monomer composition (in the oil phase)

The content of the metal chelate forming agent used in the invention is preferably in the range from 0.01 to 1 part by weight, more preferably from 0.02 to 0.5 part by weight, even more preferably from 0.05 to 0.3 part by weight for 100 parts by weight of the polymerizable monomer.

If the content of the metal chelate forming agent is less than the range, a free metal cannot be sufficiently captured. Thus, the generation of small diameter microparticles as a by-product in the polymerization cannot be sufficiently inhibited so that a bad effect may be produced onto printing performances. On the other hand, if the content of the metal chelate forming agent is more than the range, the particle size distribution of the toner deteriorates. Thus, when the toner is fixed, a failure in the toner fixation may be caused to produce a bad effect on printing performances.

(2) Suspending Step of Yielding a Suspension (Droplet Forming Step)

The polymerizable monomer composition yielded in the polymerizable monomer composition preparing step (1) is suspended into an aqueous dispersion medium containing a dispersion stabilizer to yield a suspension (polymerizable monomer composition dispersion liquid). The word "suspension" means that droplets of the polymerizable monomer composition are formed in an aqueous dispersion medium. Dispersing treatment for forming the droplets may be performed using a machine wherein intense mixing can be attained, for example, an in-line type emulsification disperser (trade name: MILDER, manufactured by Pacific Machinery & Engineering Co., Ltd.), or a high-speed emulsifying/dispersing machine (trade name: T. K. HOMOMIXER, manufactured by Tokushu Kika Kogyo Co., Ltd.).

In the suspending step in the invention, the aqueous dispersion medium is used in a state that a dispersion stabilizer is incorporated into the medium in order to control the particle diameter of the colored resin particles and improve the circularity thereof.

The aqueous dispersion medium may be water alone. Water may be used together with a water-soluble solvent such as a lower alcohol or a lower ketone.

Examples of the dispersion stabilizer include sulfates such as barium sulfate and calcium sulfate; carbonates such as barium carbonate, calcium carbonate and magnesium carbonate; phosphates such as calcium phosphate; metal compounds including metal oxides such as aluminum oxide and titanium oxide, and metal hydroxides such as aluminum hydroxide, magnesium hydroxide and ferric hydroxide; water-soluble polymeric compounds such as polyvinyl alcohol, methylcellulose and gelatin; and organic polymeric compounds such as anionic surfactant, nonionic surfactant and ampholytic surfactants. Of these examples, metal hydroxides are preferred, and magnesium hydroxide, which is usually used in a pH range of 7.5 to 11, is in particular preferred.

It is preferred to use, out of the dispersion stabilizers, a dispersion stabilizer containing a colloid of a hardly water-soluble metal hydroxide (hardly water-soluble inorganic compound), which is soluble in an acid solution.

The above-mentioned dispersion stabilizers may be used alone or in combination of two or more thereof.

The addition amount of the dispersion stabilizer is preferably in the range from 0.1 to 20 parts by weight, more preferably from 0.2 to 10 parts by weight for 100 parts by weight of the polymerizable monomer.

In the invention, an inhibitor of small diameter microparticle production is used in an amount in a specified range, which will be detailed later, to inhibit effectively the generation of small diameter microparticles as a by-product in the polymerization for the toner.

In the invention, the "inhibitor of small diameter microparticle production" is a compound having an effect of capturing radicals originating from the polymerizable monomer and/or radicals originating from a polymerization initiator, which are unfavorably present (are eluted out) in the aqueous dispersion medium (in the aqueous phase) in the step of forming the droplets of the polymerizable monomer composition, thereby inhibiting the generation of small diameter microparticles as a by-product in the polymerization for the toner.

The inhibitor of small diameter microparticle production used in the invention is preferably an inhibitor of small diameter microparticle production having a structure represented by Formula 1, 2 or 3 illustrated below since the effect of inhibiting the generation of small diameter microparticles as a by-product in the polymerization is high.

Formula 1:

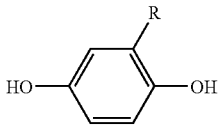

Formula 2:

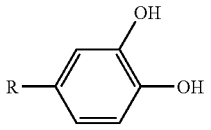

Formula 3:

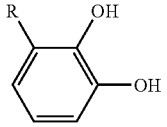

wherein, in the Formulae 1 to 3, R is OX, $SO_3X$, $CO_2X$, or $CH{=}CHCO_2X$; and X is hydrogen or a metal.

Examples of the metals in metal salts of polyhydric phenolic compounds represented by the Formulae 1 to 3 include monovalent metals such as lithium, sodium, and potassium; and polyvalent metals such as magnesium, calcium, and aluminum. The metals in the polyhydric phenolic compound metal salts are each preferably a monovalent metal from the viewpoint of the compatibility (solubility) between each of the polyhydric phenolic compound metal salts (inhibitor of small diameter microparticle production) and the aqueous dispersion medium (aqueous phase).

Examples of the inhibitor of small diameter microparticle production represented by the Formula 1 include hydroxyhydroquinone, hydroquinonesulfonic acid, hydroquinone carboxylic acid, and metal salts thereof. Examples of the inhibitor of small diameter microparticle production represented by the Formula 2 include caffeic acid, 3,4-dihydroxybenzoic acid, 3,4-dihydroxybenzenesulfonic acid, and metal salts thereof. Examples of the inhibitor of small diameter microparticle production represented by the Formula 3 include pyrogallol, 2,3-dihydroxybenzoic acid, 2,3-dihydroxybenzenesulfonic acid, 2,3-dihydroxycinnamic acid, and metal salts thereof. Of these inhibitors of small diameter microparticle production, pyrogallol, hydroxyhydroquinone and caffeic acid are preferably used since the effect of inhibiting the generation of small diameter microparticles as a by-product in the polymerization is high.

The timing when the inhibitor of small diameter microparticle production used in the invention is added is not particularly limited as long as the suspension can contain the small diameter microparticle inhibitor in an amount in the specified range, which will be specifically described in the next paragraph, when the suspension is subjected to suspension polymerization. It is more preferred to add the inhibitor of small diameter microparticle production to the aqueous dispersion medium than to the polymerizable monomer composition when the composition is prepared. About the timing when the inhibitor of small diameter microparticle production is added to the aqueous dispersion medium, the inhibitor of small diameter microparticle production may be added to the aqueous dispersion medium at a stage before or after the dispersion stabilizer is added, before or after the polymerizable monomer composition is charged, before or after a polymerization initiator is added, or before or after the metal chelate forming agent is added. It is particularly preferred to add the inhibitor to the aqueous dispersion medium after the droplets of the polymerizable monomer composition are formed, that is, to the suspension since the effect of inhibiting the generation of small diameter microparticles as a by-product in the polymerization is high.

The addition amount of the inhibitor of small diameter microparticle production used in the invention is in the range from 0.01 to 1 part by weight, preferably from 0.03 to 0.8 part by weight, more preferably from 0.05 to 0.5 part by weight for 100 parts by weight of the polymerizable monomer.

If the addition amount of the inhibitor of small diameter microparticle production used in the invention is less than the range, polymerization reaction of the polymerizable monomer which is eluted out (is present) in the aqueous dispersion medium (in the aqueous phase) cannot be inhibited (stopped) so that the generation of small diameter microparticles as a by-product may not be sufficiently inhibited in the polymerization. On the other hand, if the addition amount of the inhibitor of small diameter microparticle production used in the invention is more than the range, a desired polymerization reaction of the polymerizable monomer composition is inhibited so that the polymerizable monomer remains in a large amount in the toner without being polymerized.

The polymerization initiator used in the invention is preferably an organic peroxide. In general, the organic peroxide is roughly classified into seven species of a hydroperoxide compound, a dialkylperoxide compound, a peroxyester compound, a diacylperoxide compound, a peroxydicarbonate compound, a peroxyketal compound and a ketone peroxide compound.

The polymerization initiator used in the invention is more preferably, out of these species, a peroxyester compound represented by Formula 10 illustrated below.

Formula 10:

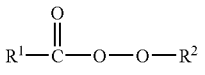

wherein, in the Formula 10, $R^1$ and $R^2$ are each any alkyl group having 1 to 10 carbon atoms.

$R^1$ in the Formula 10 is preferably an alkyl group having 8 or less carbon atoms, more preferably an alkyl group having 7 or less carbon atoms. Specific examples of $R^1$ include i-propyl, 1-methylpropyl, 1-ethylpropyl, 1-methylbuytl, 2-methylbutyl, 1-ethylbutyl, 2-ethylbutyl, 1-methylpentyl, 2-methylpentyl, 1-ethylpentyl, 2-ethylpentyl, 1-methylhexyl, 2-methylhexyl, 1-ethylhexyl, and 2-ethylhexyl. Particularly preferred is 1-ethylpentyl.

$R^2$ in the Formula 10 is preferably an alkyl group having 10 or less carbon atoms, more preferably an alkyl group having 6 or less carbon atoms. Specific examples of $R^2$ include t-butyl, t-hexyl, and t-amyl. Particularly preferred is t-butyl group.

Specific examples of the peroxyester compound having the structure represented by the Formula 10 include t-butylperoxy-2-ethylbutanoate (Formula 11 illustrated below), and t-butylperoxy-2-ethyl hexanoate (Formula 12 illustrated below). Of these examples, t-butylperoxy-2-ethyl butanoate is preferred to decrease the remaining amount of a decomposition product (volatile organic compound) of the polymerization initiator, which may cause a bad swell, remaining in the toner. In order to inhibit the generation of small diameter microparticles as a by-product in the polymerization, t-butylperoxy-2-ethyl hexanoate is preferred. As the polymerization initiator in the invention, t-butylperoxy-2-ethyl hexanoate is more preferably used.

Formula 11:

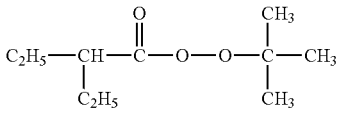

Formula 12:

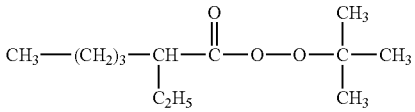

The timing when the polymerization initiator used in the invention is added is not particularly limited as long as the suspension can contain the polymerization initiator when the suspension is subjected to suspension polymerization. It is more preferred to add the polymerization initiator to the aqueous dispersion medium after the droplets are formed than to the polymerizable monomer composition when the composition is prepared.

The addition amount of the polymerization initiator used in the invention is preferably in the range from 0.1 to 20 parts by weight, more preferably from 0.3 to 15 parts by weight, even more preferably from 1 to 10 parts by weight for 100 parts by weight of the polymerizable monomer.

(3) Polymerizing Step

The suspension (aqueous dispersion medium containing the droplets of the polymerizable monomer composition) yielded through the suspension-yielding step (2) is subjected to suspension polymerization in the presence of a polymerization initiator to yield an aqueous dispersion liquid of colored resin particles. In order to perform the polymerization in a state that the droplets of the polymerizable monomer composition are stably dispersed in the polymerizing step, it is preferred that after the suspension-yielding step (2), the polymerization reaction is advanced while dispersing treatment based on stirring is performed.

In the polymerizing step, the polymerizing temperature is preferably 50° C. or higher, more preferably in the range from 60 to 98° C. The polymerizing time is preferably in the range from 1 to 20 hours, more preferably from 2 to 15 hours.

When the suspension polymerization is performed in the invention, an inhibitor of small diameter microparticle production, the contents of which have been detailed above, may be added in such a manner that the suspension contains the inhibitor in amounts in the specified ranges, thereby making it possible to inhibit effectively the generation of small diameter microparticles as a by-product in the polymerization for the toner.

In a first embodiment of the invention, when the suspension polymerization is performed, a metal chelate forming agent and an inhibitor of small diameter microparticle production, the contents of which have been detailed above, may be added in such a manner that the suspension contains the agent and the inhibitor in amounts in the specified ranges, thereby making it possible to inhibit more effectively the generation of small diameter microparticles as a by-product in the polymerization for the toner.

Accordingly, the average number of the small diameter microparticles which adhere to the each colored resin particles may be set preferably to 100 or less, more preferably to 50 or less, even more preferably to 30 or less.

Also, in a second embodiment of the invention, a copper phthalocyanine pigment wherein the content of free copper was reduced into the specified amount or less was used as the colorant, and when the suspension polymerization is performed, an inhibitor of small diameter microparticle production, the contents of which have been detailed above, may be added in such a manner that the suspension contains the agent and the inhibitor in amounts in the specified ranges, thereby making it possible to inhibit more effectively the generation of small diameter microparticles as a by-product in the polymerization for the toner.

Accordingly, the average number of the small diameter microparticles which adhere to the each colored resin particles may be set preferably to 100 or less, more preferably to 80 or less, even more preferably to 50 or less.

The average number of the small diameter microparticles which adhere to the each colored resin particles is a value obtained by collecting the aqueous dispersion liquid containing the colored resin particles after the polymerizing step, making a sample for a scanning electron microscope (SEM) described below, using the scanning electron microscope to photograph images of 5 microscopic fields of the sample, which is obtained by the adjustment, with a magnification of 5,000, selecting five out of the colored resin particles at random in each of the images, counting the number of the small diameter microparticles observed in surfaces of the 25 colored resin particles, and then calculating out, from this result, the average number of the small diameter microparticles which adhere to the each colored resin particles.

The number of the small diameter microparticles which adhere to the each colored resin particles can be measured using a commercially available scanning electron microscope, and may be measured using, for example, a field emission type scanning electron microscope (tradename: S-4700, manufactured by Hitachi Ltd.).

In the invention, it is preferred to prepare the so-called core-shell structured (or "encapsulated") colored resin particles, which are obtained by making the colored resin particles yielded through the polymerizing step into a core layer and then forming, outside the layer, a shell layer different from the core layer.

The core-shell structured colored resin particles can gain a balance between a fall in the fixing temperature of the toner and preventability of aggregations thereof when the toner is stored by covering the core layer, which is made of the low-softening-point material, with a material having a higher softening point than the core layer.

The method for producing the core-shell structured colored resin particles is not particularly limited, and the particles may be produced by a method known in the prior art. From the viewpoint of production efficiency, an in-situ polymerization method or a phase separation method is preferred.

A method of producing core-shell structured colored resin particles according to an in-situ polymerization method will be described hereinafter.

A shell-layer-forming polymerizable monomer (polymerizable monomer for shell) and a polymerization initiator for shell are added to the above-mentioned aqueous dispersion medium wherein the colored resin particles are dispersed, and the monomer is polymerized, whereby core-shell structured colored resin particles can be yielded.

As the polymerizable monomer for shell, the same polymerizable monomers as described above may be used. It is preferred to use, out of the monomers, monomers which can each give a polymer having a Tg higher than 80° C., such as styrene and methyl methacrylate, alone or in combination of two or more thereof.

Examples of the polymerization initiator for shell, which is used to polymerize the polymerizable monomer for shell, include metal salts of persulfuric acid, such as potassium persulfate and ammonium persulfate; and water-soluble azo compounds, such as 2,2'-azobis(2-methyl-N-(2-hydroxyethyl)propionamide), and 2,2'-azobis-(2-methyl-N-(1,1-bis(hydroxymethyl)-2-hydroxyeth yl)propionamide).

The addition amount of the polymerization initiator for shell used in the invention is preferably in the range from 0.1 to 30 parts by weight, more preferably from 1 to 20 parts by weight for 100 parts by weight of the polymerizable monomer for shell.

The polymerizing temperature for the shell layer is preferably 50° C. or higher, more preferably in the range from 60 to 95° C. The polymerizing time for the shell layer is preferably in the range from 1 to 20 hours, more preferably from 2 to 15 hours.

(4) Washing, Filtrating, Dehydrating, and Drying Step

The aqueous dispersion liquid of the colored resin particles, which is obtained through the polymerizing step (3), is subjected to a series of washing, filtrating and dehydrating operations in accordance with a usual method, and the operations are repeated several times as the need arises. The resultant solid is dried, thereby yielding colored resin particles.

First, an acid or alkali is added to the aqueous dispersion liquid of the colored resin particles so as to wash the particles in order to remove the dispersion stabilizer remaining in the aqueous dispersion liquid of the colored resin particles.

In a case where the used dispersion stabilizer is an acid-soluble inorganic compound, an acid is added to the aqueous dispersion liquid of the colored resin particles. On the other hand, in a case where the used dispersion stabilizer is an alkali-soluble inorganic compound, an alkali is added to the aqueous dispersion liquid of the colored resin particles.

When the acid-soluble inorganic compound is used as the dispersion stabilizer, it is preferred that the acid is added to the aqueous dispersion liquid of the colored resin particles to perform acid washing until the pH turns into 6.5 or less. The acid added in the acid washing may be an inorganic acid such as sulfuric acid, hydrochloric acid or nitric acid; or an organic acid such as formic acid or acetic acid; or the like. Of these acids, sulfuric acid is particularly preferred since sulfuric acid is good in removing-efficiency of the dispersion stabilizer so that only a small burden is imposed on facilities for producing the toner.

After the acid or alkali is added to the aqueous dispersion liquid of the colored resin particles, which is obtained through the polymerizing step, so as to perform the washing, the resultant is subjected to filtrating separation. Ion exchange water is added to the resultant solid to make the solid again in to a slurry. The slurry is subjected to washing treatment with a washing liquid, such as water (washing/filtration/dehydration), and the treatment is repeated several times. The resultant solid is dried to yield colored resin particles.

The methods for the washing treatment and the drying treatment are not particularly limited, and may be various known methods. Examples of the machine used in the washing treatment include a pillar centrifuge, and a siphon pillar centrifuge. Examples of the method used in the drying treatment include vacuum drying, and air flow drying.

(5) Colored Resin Particles

The colored resin particles, which constitute toner, will be described hereinafter. The colored resin particles described below include, in the category thereof, both of core-shell structured particles, and particles other than the core-shell structured particles.

The volume average particle diameter Dv of the colored resin particles obtained by the producing method of the invention is preferably in the range from 3 to 15 μm, more preferably from 4 to 12 μm, even more preferably from 5 to 9 μm from the viewpoint of image reproducibility.

If the volume average particle diameter Dv of the colored resin particles is less than the range, the flowability of the toner lowers so as to cause a deterioration in image quality easily by fog or the like. Thus, a bad effect may be produced on printing performances. On the other hand, if the volume average particle diameter Dv of the colored resin particles is more than the range, the resolution of obtained images lowers easily. Thus, a bad effect may be produced on printing performances.

The particle size distribution (Dv/Dp) of the colored resin particles in the invention, which is the ratio between the volume average particle diameter (Dv) thereof and the number average particle diameter (Dp) thereof, is preferably in the range from 1.0 to 1.3, more preferably from 1.0 to 1.2 from the viewpoint of image reproducibility.

If the particle size distribution (Dv/Dp) of the colored resin particles is more than the range, the flowability of the toner lowers so as to cause a deterioration in image quality easily by fog or the like. Thus, a bad effect may be produced on printing performances.

The volume average particle diameter Dv and the number average particle diameter Dp of the colored resin particles are values measured using a particle diameter measuring device.

The average circularity of the colored resin particles obtained by the producing method of the invention is preferably in the range from 0.96 to 1.00, more preferably from 0.97 to 0.995, even more preferably from 0.98 to 0.995 from the view point of image reproducibility.

If the average circularity of the colored resin particles is less than the range, the thin line reproducibility lowers easily. Thus, a bad effect may be produced on printing performances.

In the invention, the "circularity" is defined as a value obtained by dividing the perimeter of a circle having an area equal to the projected area of the image of a particle by the perimeter of the projected image of the particle. The average circularity in the invention is used as a simple manner for representing the shape of a particle quantitatively, and is an index representing the degree of unevenness of the colored resin particles. The average circularity turns into 1 when the colored resin particles are completely spherical. As the complexity of the surface shapes of the colored resin particles becomes larger, the value thereof becomes smaller. The average circularity is as follows: about a group of particles having a circular equivalent diameter of 0.6 μm or more, the circularity (Ci) of each of measured particles the number of which is n, out of the particles, is calculated in accordance with Calculating expression 1 described below; and next the average circularity (Ca) of the resultant circularities is calculated in accordance with Calculating expression 2 described blow.

Circularity (Ci)=the perimeter of a circle having an area equal to the projected area of a particle/the perimeter of the projected image of the particle — Calculating expression 1

Calculating expression 2:

$$Ca = \frac{\sum_{i=1}^{n} (Ci \times fi)}{\sum_{i=1}^{n} (fi)}$$

wherein, in the Calculating expression 2, the symbol "fi" is the frequency of the particles having a circularity (Ci).

The circularity can be measured using a flow type particle image analyzer "FPIA-2000", "FPIA-2100", "FPIA-3000" (trade name; manufactured by Sysmex Co.) or the like.

(6) Toner

The colored resin particles obtained by the invention may be used, as they are, as a toner, or a combination of the particles and carrier particles (such as ferrite or iron particles) is used as a toner. Using a high-speed mixer (trade name: FM MIXER, manufactured by Mitsui Mining Co., Ltd., or the like), an external additive may be mixed with the colored resin particles, thereby preparing a one-component toner, or an external additive and carrier particles may be mixed with the colored resin particles, thereby preparing a two-component toner in order to adjust the charging property, the fluidity, the storability and other properties of the toner.

Examples of the external additive include inorganic microparticles made of silica, titanium oxide, aluminum oxide, zinc oxide, tin oxide, calcium carbonate, calcium phosphate, or cerium oxide; and organic microparticles made of polymethyl methacrylate resin, silicone resin, or melamine resin. Of these additives, inorganic microparticles are preferred. Of the inorganic microparticles, microparticles made of silica or titanium oxide are preferred, and microparticles made of silica are particularly preferred. The external additives may be used alone; the additives are preferably used in combination of two or more thereof.

In the invention, it is desired that the external additive is used usually in a proportion of 0.1 to 6 parts by weight, preferably in that of 0.2 to 5 parts by weight for 100 parts by weight of the colored resin particles.

About the toner produced through the steps (1) to (6), the inhibitor of small diameter microparticle production is added in such a manner that the suspension contains the inhibitor of small diameter microparticle production in an amount in the specified range when the suspension polymerization is conducted, whereby it possible to inhibit the polymerization reaction of the polymerizable monomer, which is present (or is eluted out) in the aqueous dispersion medium (in the aqueous phase). For this reason, the generation of small diameter microparticles as a by-product in the polymerization for the toner can be effectively inhibited, and the washing treatment (washing/filtration/dehydration) becomes easy or simple. Thus, the toner is a toner excellent in productivity and printing performances.

EXAMPLES

The invention will be more specifically described by way of the following working examples and comparative examples; however, the invention is not limited only to the working examples. Unless otherwise specified, the word "part(s)" and symbol (%) mean part(s) by weight and % by weight, respectively.

Evaluating methods performed in the working examples and the comparative examples are as follows:

<Evaluating Methods>

(1) Measurement of a Free Metal (Free Copper)

One gram of a sample to be measured (copper phthalocyanine pigment) was precisely weighed, and the sample was put into a 50-mL ground stopper conical flask. Thereto was added 30 mL of a 0.1 M solution of hydrochloric acid in water, and the flask was air tightly stopped. A shaker (trade name: KM SHAKER, manufactured by Iwaki Co.) was used to shake the flask under a shaking condition that the number of shakes was 300 per minute for 1 hour. After the shaking, the solution of hydrochloric acid in water containing the metal-containing organic pigment (copper phthalocyanine pigment) was filtrated through a glass filter, and then 45 mL of a 0.1 M solution of hydrochloric acid in water was added to 5 mL of the resultant filtration to dilute the solution 10 times. In this way, a sample solution was prepared.

About the prepared sample solution, a polarized Zeeman atomic absorption spectrometer (trade name: Z-5010, manufactured by Hitachi Ltd.) was used to measure the absorption spectrum of the free metal (free copper) contained in the sample solution. The amount of the free metal (free copper) contained in the sample solution was then calculated. The value was conversed to the amount of the free metal (free copper) contained in the metal-containing organic pigment (copper phthalocyanine pigment).

(2) Colored Resin Particles (2-1) Volume Average Particle Diameter Dv and Particle Size Distribution Dv/Dp Approximately 0.1 g of a sample to be measured (colored resin particles) was precisely weighed, and the sample was put into a beaker. Thereto was added 0.1 mL of a solution of alkylbenzenesulfonic acid in water (trade name: DRYWELL, manufactured by Fuji Photo Film Co., Ltd.) as a dispersing agent. To the beaker was further added 10 to 30 mL of ISOTON II, and the particles were dispersed with a 20-watt super sonic dispersing device for 3 minutes. Thereafter, a particle diameter measuring device (trade name: MULTISIZER, manufactured by Beckman Coulter Inc.) was used to measure the volume average particle diameter (Dv) and the number average particle diameter (Dp) of the colored resin particles under conditions that the aperture diameter was 100 μm, a used solvent was ISOTON II, and the number of measured ones out of the particles was 100,000. The particle size distribution (Dv/Dp) was then calculated out.

(2-2) Average Circularity

Into a vessel was beforehand put 10 mL of ion exchange water. Thereto were added 0.02 g of a surfactant (alkylbenzenesulfonic acid) as a dispersing agent and 0.02 g of colored resin particles. The resultant was subjected to dispersing treatment with an ultrasonic dispersing device at 60 watt for 3 minutes. The concentration of the colored resin particles was set into the range of 3,000 to 10,000/μL when the average circularity thereof was measured. A flow type particle image analyzer (trade name: FPIA-2100, manufactured by Sysmex Corp.) was used to measure 1,000 to 10,000 particles out of the colored resin particles having a circle equivalent diameter of 0.4 μm or more. From the measured values, the average circularity was calculated.

The circularities were each calculated in accordance with Calculating expression 1 described below, and the average circularity was obtained by averaging the circularities.

(Circularity)=(the perimeter of a circle having an area equal to the projected area of a particle)/(the periphery of the projected image of the particle) Calculating expression 1

(3) Average Number of Small Diameter Microparticles

To 3 mL of an aqueous dispersion liquid containing colored resin particles after the polymerizing step of a polymerizable monomer composition was added 1 mL of 10% $H_2SO_4$ to dissolve the dispersion stabilizer therein completely, and then 2 mL of this solution was dropped onto a filter paper piece (trade name: No. 2, manufactured by Toyo Roshi Kaisha, Ltd.), so as to be filtrated. The resultant on the filter paper piece was air-dried to prepare a sample for scanning electron microscope (SEM).

Platinum was evaporated onto the air-dried colored resin particles, and then an image of the resultant was enlarged with a magnification of 5,000 and observed with a field emission type scanning electron microscope (trade name: S-4700, manufactured by Hitachi Ltd.) at an accelerating voltage of 5 kV.

In the sample, five viewing fields were selected at random, and images in the fields were photographed. In each of the images, five particles were selected from the colored resin particles at random. The number of small diameter microparticles observed in the surfaces of the 25 colored resin particles was counted. In this way, the average number of the small diameter microparticles which adhere to the each colored resin particles was calculated.

Examples A

Example A1

In a mixer, the following were agitated and mixed to disperse the solid components uniformly: 75 parts of styrene and 24 parts of n-butyl acrylate as monovinyl monomers; 5 parts of copper phthalocyanine containing 2390 ppm of a free metal (free copper) (trade name: LINOGEN BLUE 7919, manufactured by Toyo Ink Mfg. Co., Ltd.) as a cyan colorant; 1 part of a charge control resin, specifically, a styrene/acrylic resin (trade name: FCA-161P, manufactured by Fujikura Kasei Co., Ltd.) as a charge control agent; 5 parts of dipentaerythritol hexamyristate as a release agent; and 0.1 part of 8-quinolinol (Formula 4 illustrated above) as a metal chelate forming agent. In this way, a polymerizable monomer composition was yielded.

Separately, at room temperature, an aqueous solution wherein 6.2 parts of sodium hydroxide (alkali metal hydroxide) were dissolved in 50 parts of ion exchange water were gradually added to an aqueous solution wherein 11 parts of magnesium chloride (water-soluble polyvalent metal salt) were dissolved in 200 parts of ion exchange water while the solution was stirred. This way gave a magnesium-hydroxide-colloid (water-slightly-soluble metal-hydroxide-colloid)-dispersed liquid.

The polymerizable monomer composition was added at room temperature to the magnesium hydroxide dispersed liquid yielded as described above, and the resultant was stirred. Thereto were added 5 parts of t-butylperoxy-2-ethyl hexanoate (Formula 12 illustrated above) (trade name: PERBUTYL 0, manufactured by NOF Corporation) as a polymerization initiator, 1.6 parts of t-dodecylmercaptan as a molecular weight adjustor, and 0.7 part of divinylbenzene as a crosslinkable polymerizable monomer. Thereafter, an in-line type emulsification dispersing machine (trade name: CAVITRON, manufactured by Pacific Machinery & Engineering Co., Ltd.) was used to subject the resultant to high-speed shearing agitation at a rotation number of 15,000 rpm for 1 minute, so as to disperse the solid components. In this way, droplets of the polymerizable monomer composition were formed.

To the suspension after the droplets of the polymerizable monomer composition were formed was added 0.1 part of pyrogallol (Formula 13 illustrated below) as an inhibitor of small diameter microparticle production, and further the suspension was stirred.

Formula 13:

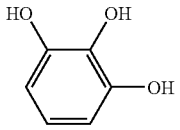

The suspension (polymerizable monomer composition dispersed liquid) yielded as described above, wherein the droplets of the polymerizable monomer composition were dispersed, was charged into a reactor to which stirring fans were fitted, and the temperature of the system was raised to 90° C. to initiate polymerization reaction. When the polymerization conversion rate reached 95%, to the suspension were added 2.1 parts of methyl methacrylate as a polymerizable monomer for shell, and 0.21 part of 2,2'-azobis(2-methyl-N-(2-hydroxyethyl)propionamide) (trade name: VA-086, manufactured by Wako Pure Chemical Industries, Ltd.; water soluble), as a polymerization initiator for shell, dissolved in 20 parts of ion exchange water. The reaction was continued at 90° C. for 3 hours, and then the system was cooled with water to terminate the reaction, thereby yielding an aqueous dispersion liquid of core-shell structured colored resin particles.

The resultant aqueous dispersion liquid of the colored resin particles was partially collected, and the number of small diameter microparticles generated as a by-product therein was measured.

At room temperature, sulfuric acid was dropwise added to the aqueous dispersion liquid of the colored resin particles, which was yielded as described above, while the liquid was stirred. In this way, acid washing was performed until the pH turned into 6.5 or less. Next, the resultant was subjected to filtrating separation, and then 500 parts of ion exchange water were added to the resultant solid to prepare a slurry again. The slurry was subjected to water washing treatment (washing/filtration/dehydration), and the treatment was repeated several times. Next, the resultant was subjected to filtrating separation, and the resultant solid was put into a container in a vacuum drying machine. The solid was vacuum-dried at a pressure of 30 torr and a temperature of 50° C. for 24 hours to yield dried colored resin particles.

The volume average particle diameter (Dv) of the resultant dried colored resin particles was 6.5 μm, the particle size distribution (Dv/Dp) was 1.13, and the average circularity was 0.971.

To 100 parts of the colored resin particles yielded as described above were added 0.8 part of silica microparticles subjected to hydrophobicity-imparting treatment (trade name: TG820F, manufactured by Cabot Corp.) and 1.0 part of silica microparticles subjected to hydrophobicity-imparting treatment (trade name: NA50Y, manufactured by Nippon Aerosil Co., Ltd.). A high-speed mixer (trade name: FM MIXER, manufactured by Mitsui Mining Co., Ltd.) was used to mix and stir the components to conduct external addition treatment. In this way, a toner for developing electrostatic image of Example A1 was produced and subjected to tests.

Example A2

A toner of Example A2 was produced and subjected to tests in the same way as in Example A1 except that the species of the inhibitor of small diameter microparticle production was changed to hydroxyhydroquinone (Formula 14 illustrated below).

Formula 14:

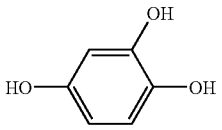

Example A3

A toner of Example A3 was produced and subjected to tests in the same way as in Example A1 except that the species of the polymerization initiator was changed to t-butylperoxy-2-ethyl butanoate (Formula 11 illustrated above) (trade name: TRIGONOX 27, manufactured by Akzo Nobel N. V.).

Comparative Example A1

A toner of Comparative Example A1 was produced and subjected to tests in the same way as in Example A1 except that the metal chelate forming agent, and the inhibitor of small diameter microparticle production were not added.

Comparative Example A2

A toner of Comparative Example A2 was produced and subjected to tests in the same way as in Example A1 except that the inhibitor of small diameter microparticle production was not added.

Comparative Example A3

A toner of Comparative Example A3 was produced and subjected to tests in the same way as in Example A3 except that the metal chelate forming agent was not added and the species of the inhibitor of small diameter microparticle production was changed to hydroquinone (Formula 15 illustrated below).

Formula 15:

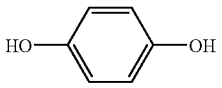

(Results)

Test results of each of Examples and Comparative Examples described above are shown in Table 1.

TABLE 1

| | | Example A1 | Example A2 | Example A3 | Comparative Example A1 | Comparative Example A2 | Comparative Example A3 |
|---|---|---|---|---|---|---|---|
| Metal chelate forming agent | Species | 8-Quinolinol | 8-Quinolinol | 8-Quinolinol | — | 8-Quinolinol | — |
| | Addition amount (parts) | 0.1 | 0.1 | 0.1 | — | 0.1 | — |
| Inhibitor of small diameter microparticle production | Species | Pyrogallol | Hydroxyhydroquinone | Pyrogallol | — | — | Hydroquinone |
| | Addition amount (parts) | 0.1 | 0.1 | 0.1 | — | — | 0.1 |
| Polymerization initiator | Species (trade name) | t-Butylperoxy-2-ethyl hexanoate (PERBUTYL 0) | t-Butylperoxy-2-ethyl hexanoate (PERBUTYL 0) | t-Butylperoxy-2-ethyl butanoate (TRIGONOX 27) | t-Butylperoxy-2-ethyl hexanoate (PERBUTYL 0) | t-Butylperoxy-2-ethyl hexanoate (PERBUTYL 0) | t-Butylperoxy-2-ethyl butanoate (TRIGONOX 27) |
| | Addition amount (parts) | 5 | 5 | 5 | 5 | 5 | 5 |
| Colored resin particles | Volume average particle diameter Dv(μm) | 6.5 | 6.5 | 6.8 | 6.7 | 6.4 | 6.8 |
| | Particle size distribution Dy/Dp | 1.13 | 1.18 | 1.19 | 1.20 | 1.25 | 1.22 |
| | Average circularity | 0.971 | 0.973 | 0.975 | 0.968 | 0.971 | 0.968 |
| Average number of small diameter microparticles in each of colored resin particles | | 4.2 | 10.2 | 35.4 | More than 100 | More than 100 | More than 100 |

(Summary of the Results)

From the test results described in Table 1, the following are understood.

In Comparative Examples A1, A2 and A3, the generation of small diameter microparticles by a by-product was unable to be sufficiently inhibited since neither metal chelate forming agent nor inhibitor of small diameter microparticle production was used in Comparative Example A1, no metal chelate forming agent was used in Comparative Example A2, and no inhibitor of small diameter microparticle production was used in Comparative Example A3.

On the other hand, in Examples A1 and A2, the generation of small diameter microparticles as a by-product in the polymerization for the toners was able to be effectively inhibited, and the toners were desired toners since a metal chelate forming agent and an inhibitor of small diameter microparticle production specified in the invention were used in amounts of the specified ranges. Example A3 was slightly poorer than Examples A1 and A2 in the effect of inhibiting the generation of small diameter microparticles as a by-product in the polymerization for the toner since TRIGONOX 27 was used as a polymerization initiator.

Examples B

Method for Producing a Copper Phthalocyanine Pigment

Production Example B1

To 90 parts of a high-boiling-point aromatic solvent (trade name: SOLVESSO 150, manufactured by Exxon Mobile Corp.) were added 30 parts of phthalic anhydride and 45 parts of urea as raw materials and 0.06 part of ammonium molybdate as a catalyst. When the solution was stirred, the temperature thereof was gradually raised. At 150° C., thereto were added 5.3 parts of copper (I) chloride as a raw material. The temperature was further raised to 175° C. while the solution was stirred. At this temperature, the raw materials were caused to react for 4 hours to yield a prepared solution.

The prepared solution yielded as described above was subjected to filtrating separation. Next, the resultant solid was washed with methanol, and then subjected to boiling treatment in 2% hydrochloric acid for 1 hour followed by boiling treatment in a 2% sodium hydroxide solution in water for 1 hour. The resultant was then subjected to filtrating separation. Next, the resultant solid was subjected to washing treatment with water (washing/filtration/dehydration). Thereafter, the resultant solid was dried to yield 26.7 parts of a crude copper phthalocyanine pigment.

Twenty five parts of the crude copper phthalocyanine pigment yielded as descried above were gradually added to 250 parts of 95% concentrated sulfuric acid while the acid was stirred. In this way, the pigment was dissolved. Next, the temperature of the solution was raised to 70° C. At this temperature, the solution was stirred for 1 hour to dissolve the pigment completely. Thereafter, this concentrated sulfuric acid solution was gradually added to 5 L of ice water to precipitate a crystal of the copper phthalocyanine pigment. The solution and the crystal were then subjected to filtrating separation. Next, the solid phase was subjected to washing treatment with water (washing/filtration/dehydration). Thereafter, the resultant solid was dried to yield 23.8 parts of a purified copper phthalocyanine pigment.

To 400 parts of the purified copper phthalocyanine pigment (C.I. Pigment Blue 15:3) yielded as described above were added 1600 parts of sodium chloride and 400 parts of diethylene glycol, and a pressurizing type kneader (manufactured by Toshin Co., Ltd.) was used to pulverize the pigment for 6 hours while the temperature of the content was kept at a temperature of 80 to 100° C. The pulverized product was treated with diluted hydrochloric acid, and the system was subjected to filtrating separation. Next, the solid was subjected to washing treatment with water (washing/filtration/dehydration). The resultant solid was dried to produce a fine purified copper phthalocyanine pigment wherein the free copper content was 100 ppm.

Production Example B2

A high-speed mixer (trade name: FM MIXER, manufactured by Mitsui Mining Co., Ltd.) was used to stir and mix 22.7 parts of the copper phthalocyanine pigment produced in production Example 1, and 1 part of a commercially available copper phthalocyanine pigment (C.I. Pigment Blue 15:3) (trade name: GC-TF, manufactured by Dainippon Ink & Chemicals, Inc.; free copper content: 2470 ppm), so as to disperse the pigments evenly. This way gave a fine purified copper phthalocyanine pigment wherein the free copper content was 200 ppm.

Example B1

A toner of Example B1 was produced and subjected to tests in the same way as in Example A1 except that the species of the cyan colorant was changed to the copper phthalocyanine pigment produced in Production Example B1, no metal chelate forming agent was used, and the species of the polymerization initiator was changed to t-butylperoxy-2-ethyl butanoate (Formula 11 illustrated above) (trade name: TRIGONOX 27, manufactured by Akzo Nobel N. V.).

The volume average particle diameter (Dv) of the colored resin particles yielded by the drying was 6.5 μm, the particle size distribution (Dv/Dp) was 1.13, and the average circularity was 0.978.

Example B2

A toner of Example B2 was produced and subjected to tests in the same way as in Example B1 except that the species of the inhibitor of small diameter microparticle production was changed to hydroxyhydroquinone (Formula 14 illustrated above).

Example B3

A toner of Example B3 was produced and subjected to tests in the same way as in Example B1 except that the species of the copper phthalocyanine pigment was changed to the copper phthalocyanine pigment produced in Production Example B2.

Example B4

A toner of Example B4 was produced and subjected to tests in the same way as in Example B1 except that the species of the polymerization initiator was changed to t-butylperoxy-2-ethyl hexanoate (Formula 12 illustrated above) (trade name: PERBUTYL O, manufactured by NOF Corporation).

Comparative Example B1

A toner of Comparative Example B1 was produced and subjected to tests in the same way as in Example B1 except that the inhibitor of small diameter microparticle production was not added.

Comparative Example B2

A toner of Comparative Example B2 was produced and subjected to tests in the same way as in Example B1 except that the species of the copper phthalocyanine pigment was changed to a commercially available copper phthalocyanine pigment, wherein the free copper content was 2470 ppm, (trade name: GC-TF, manufactured by Dainippon Ink & Chemicals, Inc.), and the species of the inhibitor of small diameter microparticle production was changed to hydroquinone (Formula 15 illustrated above).

Test results of each of Examples and Comparative Examples described above are shown in Table 2.

TABLE 2

| | | Example B1 | Example B2 | Example B3 | Example B4 | Comparative Example B1 | Comparative Example B2 |
|---|---|---|---|---|---|---|---|
| Copper phthalocyanine pigment | Species | Production Example B1 | Production Example B1 | Production Example B2 | Production Example B1 | Production Example B1 | GC-TF (manufactured by Dainippon Ink & chemicals, Inc.) |
| | Addition amount (parts) | 5 | 5 | 5 | 5 | 5 | 5 |
| | Content of free copper (ppm) | 100 | 100 | 100 | 100 | 100 | 2470 |
| Inhibitor of small diameter microparticle production | Species | Pyrogallol | Hydroxyhydroquinone | Pyrogallol | Pyrogallol | — | Hydroquinone |
| | Addition amount (parts) | 0.1 | 0.1 | 0.1 | 0.1 | — | 0.1 |
| Polymerization initiator | Species (trade name) | t-Butylperoxy-2-ethyl butanoate (TRIGONOX 27) | t-Butylperoxy-2-ethyl butanoate (TRIGONOX 27) | t-Butylperoxy-2-ethyl butanoate (TRIGONOX 27) | t-Butylperoxy-2-oxy-2-ethyl hexanoate (PERBUTYL 0) | t-Butylperoxy-2-ethyl butanoate (TRIGONOX 27) | t-Butylperoxy-2-ethyl butanoate (TRIGONOX 27) |
| | Addition amount (parts) | 5 | 5 | 5 | 5 | 5 | 5 |
| Colored resin particle | Volume average particle diameter Dv(μm) | 6.5 | 6.6 | 6.5 | 6.6 | 6.7 | 6.9 |
| | Particle size distribution Dv/Dp | 1.13 | 1.18 | 1.17 | 1.14 | 1.20 | 1.26 |
| | Average circularity | 0.978 | 0.976 | 0.978 | 0.980 | 0.972 | 0.975 |
| Average number of small diameter microparticles in each of colored resin particles | | 3.9 | 5.8 | 12.5 | 2.2 | More than 200 | More than 200 |

(Summary of the Results)

From the test results described in Table 2, the following are understood.

In Comparative Examples B1 and B2, the generation of small diameter microparticles by a by-product was unable to be sufficiently inhibited since no inhibitor of small diameter microparticle production was used in Comparative Example B1, and a copper phthalocyanine pigment containing free copper in an amount more than the specified amount was used in Comparative Example B2.

On the other hand, in Examples B1 to B3, the generation of small diameter microparticles as a by-product in the polymerization for the toners was able to be effectively inhibited, and the toners were desired toners since a copper phthalocyanine pigment wherein the content of free copper was reduced into the specified amount or less was used as the colorant, and an inhibitor of small diameter microparticle production was used in an amount in the specified range. Example B4 was better than Examples B1 to B3 in the effect of inhibiting the generation of small diameter microparticles as a by-product in the polymerization for the toner since PERBUTYL 0 was used as a polymerization initiator.

What is claimed is:

1. A method for producing a toner for developing electrostatic image, comprising a suspending step of suspending a polymerizable monomer composition containing at least a polymerizable monomer and a colorant into an aqueous dispersion medium containing a dispersion stabilizer to yield a suspension wherein droplets of the polymerizable monomer composition are dispersed, and a step of subjecting the suspension to suspension polymerization in the presence of a polymerization initiator to yield colored resin particles, wherein the colorant is a metal-containing organic pigment, and wherein an inhibitor of small diameter microparticle production having a structure represented by the following formula 1, 2, or 3 is added to the aqueous dispersion medium before or after the dispersion stabilizer is added, or before or after the polymerizable monomer composition is charged, in a ratio of 0.01 to 1 part by weight for 100 parts by weight of the polymerizable monomer:

Formula 1:

[Chemical formula 1]

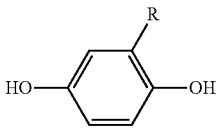

Formula 2:

[Chemical formula 2]

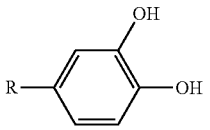

or

Formula 3:

[Chemical formula 3]

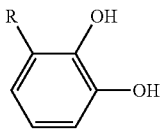

wherein R is OX, $SO_3X$, $CO_2X$, or $CH{=}CHCO_2X$; and X is hydrogen or a metal.

2. The method for producing a toner for developing electrostatic image according to claim 1, wherein the metal-containing organic pigment is a pigment comprising a phthalocyanine derivative.

3. The method for producing a toner for developing electrostatic image according to claim 2, wherein the pigment comprising a phthalocyanine derivative is a copper phthalocyanine pigment.

4. The method for producing a toner for developing electrostatic image according to claim 3, wherein the copper phthalocyanine pigment is a copper phthalocyanine pigment wherein the content of free copper is 500 ppm or less.

5. The method for producing a toner for developing electrostatic image according to claim 1, wherein when the suspension polymerization is performed, the suspension contains 0.01 to 1 part by weight of a metal chelate forming agent for 100 parts by weight of the polymerizable monomer.

6. The method for producing a toner for developing electrostatic image according to claim 5, wherein the metal chelate forming agent is a bidentate ligand having a single acidic group and a single non-acidic group.

7. The method for producing an a toner for developing electrostatic image according to claim 5, wherein the metal chelate forming agent is soluble in an aqueous dispersion medium having a pH of 7.5 to 11 before a chelate is formed, and is insoluble therein after a chelate is formed.

8. The method for producing a toner for developing electrostatic image according to claim 5, wherein the metal chelate forming agent is added to the polymerizable monomer composition when the composition is prepared.

9. The method for producing a toner for developing electrostatic image according to claim 1, wherein the inhibitor of small diameter microparticle production is added to the suspension after the formation of the droplets of the polymerizable monomer composition.

10. The method for producing a toner for developing electrostatic image according to claim 1, wherein the polymerization initiator is an organic peroxide.

11. The method for producing a toner for developing electrostatic image according to claim 10, wherein the organic peroxide is a peroxyester compound.

12. The method for producing a toner for developing electrostatic image according to claim 11, wherein the peroxyester compound is t-butylperoxy-2-ethyl hexanoate.

13. The method for producing a toner for developing electrostatic image according to claim 1, wherein the average number of small diameter microparticles which adhere to the each colored resin particles is 100 or less.

14. The method for producing a toner for developing electrostatic image according to claim 1, wherein the average circularity of the colored resin particles is in the range from 0.96 to 0.995.

15. The method for producing a toner for developing electrostatic image according to claim 1, wherein the toner for developing electrostatic image is a positively-chargeable toner.

16. The method for producing a toner for developing electrostatic image according to claim 1, wherein the inhibitor of small diameter microparticle production is selected from any of pyrogallol, hydroxyhydroquinone and caffeic acid.

* * * * *